US008764175B2

(12) United States Patent
Aznoe et al.

(10) Patent No.: US 8,764,175 B2
(45) Date of Patent: Jul. 1, 2014

(54) HEATER CONFIGURATION FOR A MELTING DEVICE WITH NON-UNIFORM THERMAL LOAD

(75) Inventors: Brian W. Aznoe, Sherwood, OR (US); James B. Campbell, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 117 days.

(21) Appl. No.: 13/559,695

(22) Filed: Jul. 27, 2012

(65) Prior Publication Data

US 2014/0028764 A1 Jan. 30, 2014

(51) Int. Cl.
*B41J 2/175* (2006.01)

(52) U.S. Cl.
CPC ..... *B41J 2/17593* (2013.01)
USPC ..... 347/88

(58) Field of Classification Search
CPC ..... B41J 2/17593
USPC ..... 347/88
See application file for complete search history.

(56) References Cited

U.S. PATENT DOCUMENTS

| | | | | |
|---|---|---|---|---|
| 2,722,977 | A * | 11/1955 | Hotchkiss | 431/59 |
| 4,458,137 | A * | 7/1984 | Kirkpatrick | 219/201 |
| 5,784,089 | A | 7/1998 | Crawford | |
| 6,905,201 | B2 | 6/2005 | Leighton | |
| 7,210,773 | B2 | 5/2007 | Jones | |
| 7,828,424 | B2 | 11/2010 | Jones et al. | |
| 2004/0114007 | A1 * | 6/2004 | Leighton | 347/88 |
| 2012/0113172 | A1 | 5/2012 | Platt et al. | |

* cited by examiner

*Primary Examiner* — Stephen Meier
*Assistant Examiner* — Alexander D Shenderov
(74) *Attorney, Agent, or Firm* — Maginot, Moore & Beck, LLP

(57) ABSTRACT

A variable resistive heater element enables current to flow through a first resistive heater element and a second resistive heater element based on the temperature of the variable resistive heater element. Current flows through the first resistive heater element, and is restricted through the second resistive heater element, when the variable resistive heater element is less than a predetermined temperature. Current flows through the first and second resistive heater elements when the variable resistive heater element is at or greater than a predetermined temperature.

16 Claims, 5 Drawing Sheets

HEATER CONFIGURATION FOR A MELTING DEVICE WITH NON-UNIFORM THERMAL LOAD

TECHNICAL FIELD

This disclosure relates generally to heaters and, in particular, to heaters used to melt phase change ink in phase change ink printers.

BACKGROUND

In general, inkjet printers include at least one printhead that ejects drops of liquid ink onto a surface of an image receiving member. A phase change inkjet printer employs phase change inks that are solid at ambient temperature, but transition to a liquid phase at an elevated temperature. The melted ink can then be ejected onto the surface of an image receiving member by a printhead. The image receiving member may be a media substrate or an intermediate imaging member, such as a rotating drum or endless belt. The image on the intermediate imaging member is later transferred to an image receiving substrate. Once the ejected ink is on the surface of the image receiving member, the ink droplets quickly solidify to form an image.

Phase change inkjet printers typically employ melting devices having one or more heated plates that melt solid phase change ink contacting the plate and deliver the melted ink to an associated printhead. The melting devices use high watt densities to rapidly heat the melt plates with associated heater elements and to provide a flow of ink to the printheads at a specified rate and temperature. This rapid heating of the melt plates, however, can cause delamination or damage to the heater elements or the melting device circuit. The problems associated with rapid heating are compounded when an uneven thermal load exists over the heated surfaces of the melt plates. For example, an uneven thermal load can occur when some regions of the melt plates are in direct contact with the solid ink and other regions are in contact with only a residual film of previously melted ink or no ink at all. Films of ink remaining outboard of the regions of the melt plates in direct contact with the solid ink can be damaged from the rapid heating.

Existing solutions to the problems associated with rapidly heating melt plates subject to non-uniform thermal loads suffer from a number of drawbacks. For instance, one solution entails providing two separate heaters and two separate heater circuits to separately control the heating of the different regions of the melt plates. This solution, however, adds significant cost to the production of the printer. Another solution is to reduce the overall power to the region of the heater that is not in contact with the thermal load. This solution becomes problematic as the melt temperature of the ink and the required drip temperature off the melt plate grow farther apart. The task of raising the molten ink to the desired drip temperature falls to the region of the melt plate having a lesser thermal load, requiring an elevated watt density to keep up with increasing ink flow rates.

What is needed, therefore, is a heater device that utilizes a cost effective single channel circuit to drive at least two heated regions with different thermal loads in an inherently safe and heat-load-balanced system. A heating device that can be operated with an effective voltage control that enables rapid initial heating of the melt plates with a high voltage followed by sustained operational heating of those plates with a reduced voltage after warm-up to prevent heater or ink damage is also desirable.

SUMMARY

A heater for use in melting solid ink has been developed that varies current flow to a plurality of resistive heater elements connected to the heater. The heater includes a first resistive heater element configured for electrical connection to an electrical power source, a second resistive heater element configured for electrical connection to an electrical return for the electrical power source, and a variable resistive heater element electrically connected at a first end to the first resistive heater element and electrically connected at a second end to the second resistive heater element, the variable resistive heater element being configured to enable electrical current to flow through the first resistive heater element, and to restrict electrical current flow through the second resistive heater element, in response to the variable resistive heater element being less than a predetermined temperature and to enable electrical current to flow through the first and the second resistive heater elements in response to the variable resistive heater element being at or greater than a predetermined temperature.

A melter device incorporates the heater to improve heat distribution over heated surfaces of the melter device. The melter device includes a first resistive heater element configured for electrical connection to an electrical power source, a second resistive heater element configured for electrical connection to an electrical return for the electrical power source, a variable resistive heater element electrically connected at a first end to the first resistive heater element and electrically connected at a second end to the second resistive heater element, the variable resistive heater element being configured to enable electrical current to flow through the first resistive heater element, and to restrict electrical current flow through the second resistive heater element, in response to the variable resistive heater element being less than a predetermined temperature and to enable electrical current to flow through the first and the second resistive heater elements in response to the variable resistive heater element being at or greater than a predetermined temperature, and a melt plate configured to receive and melt the solid ink, the melt plate having at least one planar member thermally connected to the first resistive heater element and to the second resistive heater element to enable the first resistive heater element and the second resistive heater element to heat the planar member to a temperature within a predetermined temperature range.

An inkjet printer incorporates the melter device to improve the melting of solid ink. The inkjet printer includes an inkjet printing apparatus having a plurality of inkjet ejectors, the inkjet printing apparatus being configured to eject ink from the inkjet ejectors onto a substrate, a first resistive heater element configured for electrical connection to an electrical power source, a second resistive heater element configured for electrical connection to an electrical return for the electrical power source, a variable resistive heater element electrically connected at a first end to the first resistive heater element and electrically connected at a second end to the second resistive heater element, the variable resistive heater element being configured to enable electrical current to flow through the first resistive heater element, and to restrict electrical current flow through the second resistive heater element, in response to the variable resistive heater element being less than a predetermined temperature and to enable electrical current to flow through the first and the second resistive heater elements in response to the variable resistive heater element being at or greater than a predetermined temperature, and a melt plate configured to receive and melt solid ink for delivery of the melted ink to the inkjet printing apparatus, the melt plate having at least one planar member thermally connected to the first resistive heater element and to the second resistive heater element to enable the first resistive heater element and the second resistive heater element to heat the planar member to a temperature within a predetermined temperature range.

BRIEF DESCRIPTION OF THE DRAWINGS

The foregoing aspects and other features of a heater device configured to vary electrical current flow to a plurality of resistive heater elements are explained in the following description, taken in connection with the accompanying drawings.

DETAILED DESCRIPTION

Figure 1:
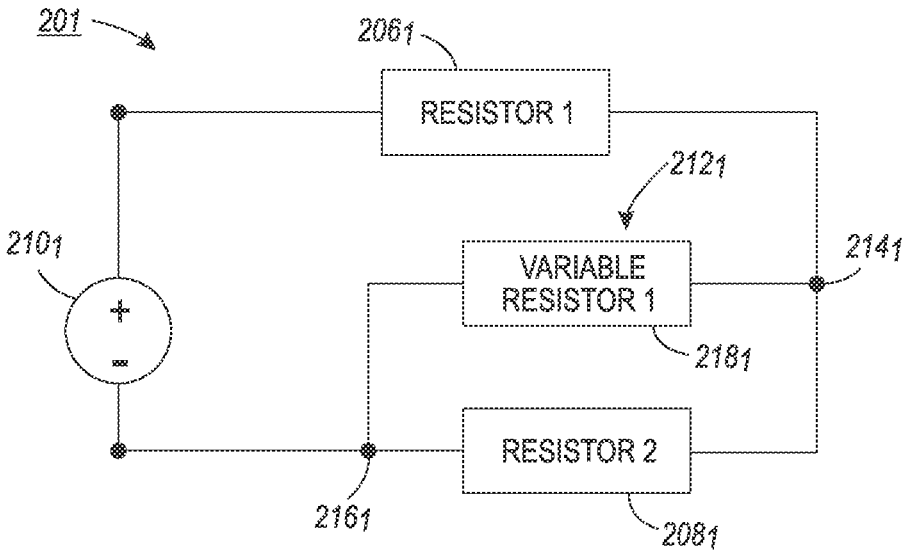
FIG. 1 is an electrical circuit diagram illustrating one embodiment of a heater device configured to vary electrical current flow to a plurality of resistive heater elements.

For a general understanding of the present embodiments, reference is made to the drawings. In the drawings, like reference numerals have been used throughout to designate like elements. As used herein, the term "melt temperature" or "melting temperature" means a temperature at which solid phase change ink initially changes phase from a solid form to a liquid form. As used herein, the term "non-melt temperature" or "non-melting temperature" mean a temperature that is below the melt temperature. As used herein, the term "drip temperature" means a temperature at which melted phase change ink drips off of a heated melting surface due to gravitation forces.

Figure 5:
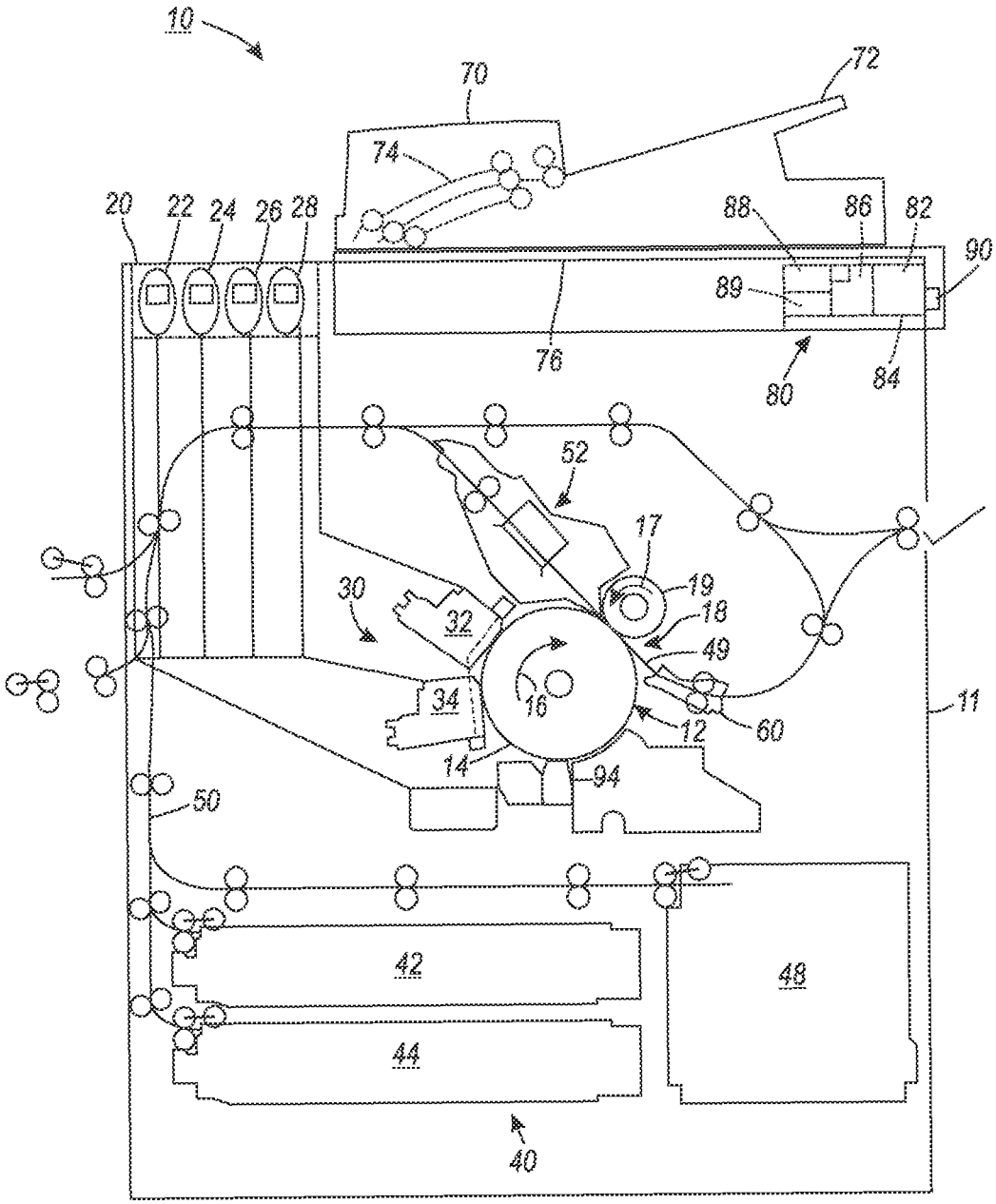
FIG. 5 (PRIOR ART)
FIG. 5 is a block diagram of a phase change ink printer.

Referring now to FIG. 5, a phase change ink printer 10 is depicted. As illustrated, the printer 10 includes a frame 11 to which are mounted directly or indirectly all operating subsystems and components of the printer 10. The printer 10 further includes an image receiving member 12 that is shown in the form of a drum, but can equally be in the form of a supported endless belt. The image receiving member 12 has an imaging surface 14 that is movable in the direction 16, and on which phase change ink images are formed. As used herein, "process direction" refers to the direction in which the image receiving member 12 moves as the imaging surface 14 passes the printhead to receive the ejected ink and "cross-process direction" refers to the direction across the width of the image receiving member 12 that is perpendicular to the process direction. An actuator (not shown) is operatively connected to the image receiving member 12 and configured to rotate the image receiving member 12 in the direction 16.

The printer 10 further includes a phase change ink system 20 that has at least one source 22 of one color phase change ink in solid form. As illustrated, the printer 10 is a multicolor printer, and the ink system 20 includes four sources 22, 24, 26, 28, representing four different colors of phase change inks, e.g., CYMK (cyan, yellow, magenta, and black). The phase change ink system 20 also includes a phase change ink melting and control assembly (not shown) for melting or phase changing the solid form of the phase change ink into a liquid form. Phase change ink is typically solid at room temperature. The ink melting assembly is configured to heat the phase change ink to a melting temperature selected to phase change or melt the solid ink to its liquid or melted form. As is generally known, phase change inks are typically heated to a melting temperature of approximately 70° C. to 140° C. to melt the solid ink for delivery to the printhead(s).

After the solid ink is melted, the phase change ink melting and control assembly controls and supplies the molten liquid form of the ink towards a printhead system 30 including at least one printhead assembly 32 and, in the figure, a second printhead assembly 34. Assemblies 32 and 34 include printheads that enable color or monochrome printing. In one embodiment, each assembly holds two printheads, each of which ejects four colors of ink. The printheads in each assembly are stitched together end-to-end to form a full-width four color array. In another embodiment, each printhead assembly 32 and 34 includes four separate printheads, i.e., one printhead for each color. In yet another embodiment, the printheads of assembly 34 are offset from the printheads of assembly 32 by one-half of the distance between nozzles in the cross-process direction. This arrangement enables the two printhead assemblies, each printing at the first resolution, for example, 300 dpi, to print images at a higher second resolution, in this example, 600 dpi. This higher second resolution can be achieved with multiple full-width printheads or numerous staggered arrays of printheads. In this embodiment, the staggered array in one printhead assembly ejecting one color of ink at the first resolution is offset from the staggered array in the other printhead assembly ejecting the same color of ink by the amount noted previously to enable the printing in the color at the higher second resolution. Thus, the two assemblies, each having four staggered arrays or four full-width printheads, can be configured to print four colors of ink at the second higher resolution. While two printhead assemblies are shown in the figure, any suitable number of printheads or printhead assemblies can be employed.

Referring still to FIG. 5, the printer 10 further includes a substrate supply and handling system 40. The substrate supply and handling system 40 includes substrate supply sources 42, 44, and 48, of which supply source 48, for example, is a high capacity paper supply or feeder configured to store and supply image receiving substrates in the form of cut sheets. The substrate supply and handling system 40 further includes a substrate handling and treatment system 50 that has a substrate pre-heater 52 and can also include a fusing/spreading device 60. The printer 10 as shown can also include an original document feeder 70 that has a document holding tray 72, document sheet feeding and retrieval devices 74, and a document exposure and scanning system 76.

Sheets (substrates) comprising any medium on which images are to be printed, such as paper, transparencies, boards, labels, and the like are drawn from the substrate supply sources 42, 44, 48 by feed mechanisms (not shown). The substrate handling and treatment system 50 moves the sheets in a process direction (P) through the printer for transfer and fixing of the ink image to the media. The substrate handling and treatment system 50 can comprise any form of device that is adapted to move a sheet or substrate. For example, the substrate handling and treatment system 50 can include nip rollers or a belt adapted to frictionally move the sheet and can include air pressure or suction devices to produce sheet movement. The substrate handling and treatment system 50 can further include pairs of opposing wheels (one or both of which can be powered) that pinch the sheets.

Operation and control of the various subsystems, components, and functions of the printer 10 are performed with the aid of a controller 80. The controller 80, for example, is a self-contained, dedicated mini-computer having a central processor unit (CPU) 82 with electronic storage 84, and a display or user interface (UI) 86. The controller 80 includes a sensor input and control circuit 88 as well as a pixel placement and control circuit 89. In addition, the CPU 82 reads, captures, prepares, and manages the image data flow from the image input sources, such as the scanning system 76 or an online or a work station connection 90. The controller 80 generates the firing signals for operating the printheads in the printhead assemblies 32 and 34 with reference to the image data. As such, the controller 80 is the main multi-tasking processor for operating and controlling all of the other printer subsystems and functions.

The controller 80 further includes memory storage for data and programmed instructions. The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the functions of the printer 10. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, image data for an image to be produced is sent to the controller 80 from either the scanning system 76 or via the online or work station connection 90 for processing and output to the printhead assembly 32. Additionally, the controller 80 determines and/or accepts related subsystem and component controls, for example, from operator inputs via the user interface 86, and accordingly operates the components of the printer with reference to these controls. As a result, appropriate color solid forms of phase change ink are melted and delivered to the printhead assemblies 32 and 34. Pixel placement control is exercised relative to the imaging surface 14 to form desired images that correspond to the image data being processed, and image receiving substrates are supplied by any one of the sources 42, 44, 48 and handled by the substrate handling and treatment system 50 in timed registration with image formation on the surface 14. Finally, the image is transferred from the surface 14 onto the receiving substrate within a transfer nip 18 formed between the imaging member 12 and a transfix roller 19 that rotates in direction 17. The media bearing the transferred ink image can then be delivered to the fusing/spreading device 60 for subsequent fixing of the image to the substrate.

The printer 10 includes a drum maintenance unit (DMU) 94 to facilitate with transferring the ink images from the surface 14 to the receiving substrates. The drum maintenance unit 94 is equipped with a reservoir that contains a fixed supply of release agent, e.g., silicon oil, and an applicator for delivering the release agent from the reservoir to the surface of the rotating member. One or more elastomeric metering blades are also used to meter the release agent on the transfer surface at a desired thickness and to divert excess release agent and un-transferred ink pixels to a reclaim area of the drum maintenance unit. The collected release agent is filtered and returned to the reservoir for reuse.

Figure 6:
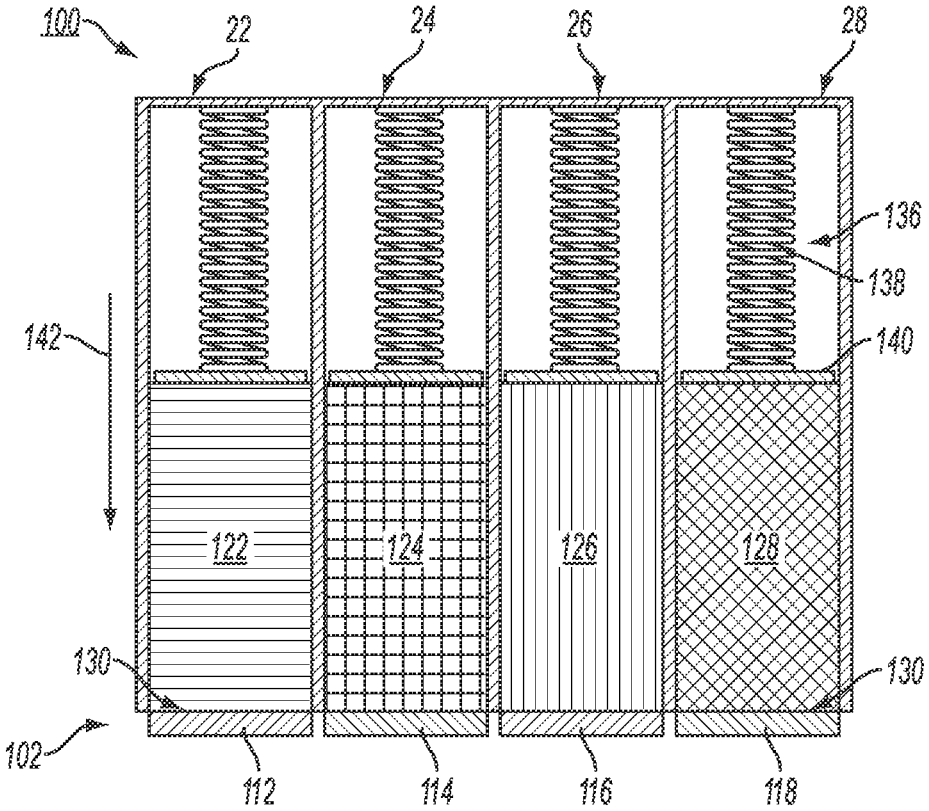
FIG. 6 is a top view of four ink sources and a melter assembly having four melt plates.
Figure 7:
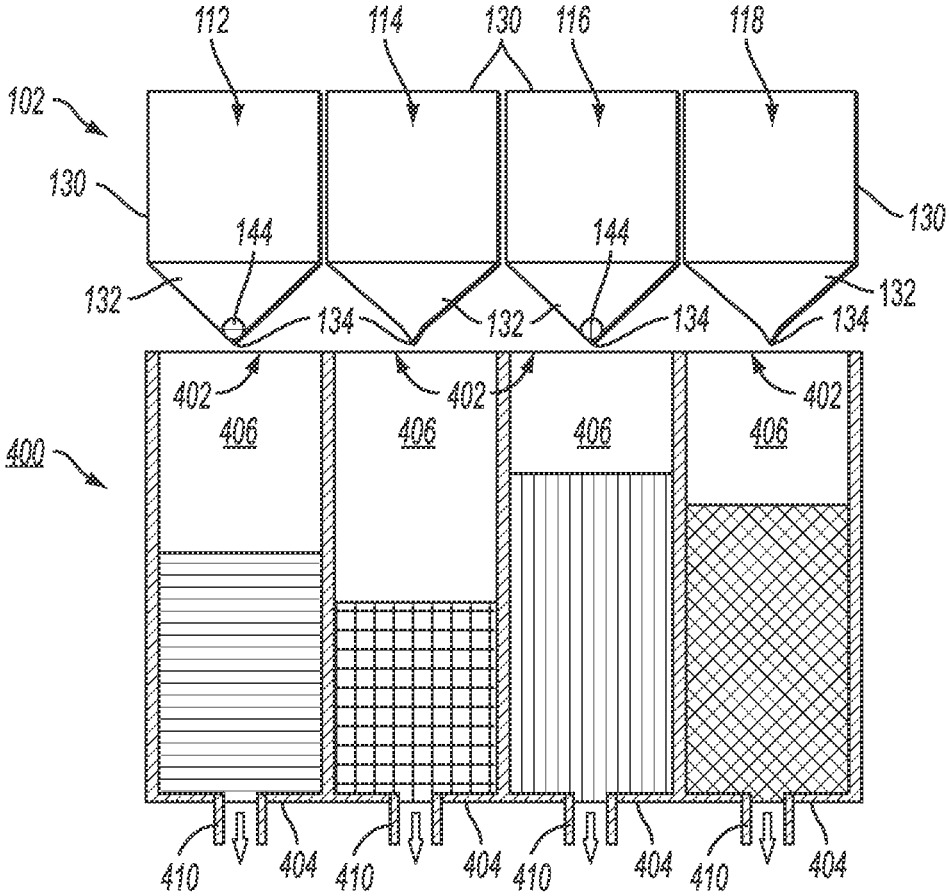
FIG. 7 is a front side view of the melter assembly of FIG. 6 in operative association with an ink storage and supply assembly.

Referring now to FIGS. 6 and 7, the ink delivery system 100 (FIG. 6) and the ink storage and supply assembly 400 (FIG. 7) of the printer 10 are shown. The ink delivery system 100 includes four (4) ink sources 22, 24, 26, 28 with each source configured to hold a different phase change ink in solid form, such as inks of different colors. However, the ink delivery system 100 can include any suitable number of ink sources with each source similarly configured to hold a different phase change ink in solid form. The different solid inks are referred to herein by their colors as CYMK, including cyan 122, yellow 124, magenta 126, and black 128. Each ink source can include a housing (not shown) for storing each solid ink separately from the others. The solid inks are typically in block form though the solid inks can be in other forms, including but not limited to, pellets and granules, among others.

The ink delivery system 100 further includes a melter assembly, shown generally at 102. The melter assembly 102 includes a melting device, such as a melt plate, connected to the ink source for melting the solid phase change ink into the liquid phase. As shown, the melter assembly 102 includes four melt plates, 112, 114, 116, and 118 with each plate corresponding to a separate ink source 22, 24, 26, and 28, respectively, and connected thereto. Each melt plate 112, 114, 116, and 118 includes an ink contact portion 130 and a drip point portion 132. The melt plates 112, 114, 116, and 118 can have additional surface areas extending above and to the sides of the ink contact portion 130 to ensure the melt front is captured and to allow for imperfect alignment of the solid ink. The drip portion 132 extends below the ink contact portion 130 and terminates at a drip point 134 at the lowest end (FIG. 7). The drip point portion 132 can be a narrowing portion terminating at the drip point 134.

The melt plates 112, 114, 116, and 118 can be formed of a thermally conductive material, such as metal, that is heated in a known manner. Heating of the melt plates 112, 114, 116, and 118 is discussed in more detail below. In one embodiment, solid phase change ink is heated to about 70° C. to 140° C. to melt the solid ink to liquid form and supply liquid ink to the liquid ink storage and supply assembly 400. As each color ink melts, the ink adheres to its corresponding melt plate 112, 114, 116 118, and gravity moves the liquid ink down to the drip point 134. The liquid ink then drips from the drip point 134 in drops shown at 144. The melted ink from the melt plates 112, 114, 116, 118 can be directed gravitationally or by other means to the ink storage and supply assembly 400. The ink storage and supply system 400 can be remote from the printheads of the printhead assembly 32.

With further reference to FIG. 7, the ink storage and supply system 400 includes ink reservoirs 404 configured to hold quantities of melted ink from the corresponding ink sources/melting devices and to communicate the melted ink to one or more printheads as needed via a melted ink communication path. Each reservoir 404 includes an opening 402 positioned below the corresponding melt plate and configured to receive the melted ink and a chamber 406 positioned below the opening 402 and configured to hold a volume of the melted ink received from the corresponding melt plate. The remote reservoirs 404 are each heated by a reservoir heater (not shown) that can be a common heater for all of the reservoirs or a dedicated heater for each individual reservoir. The reservoir heater(s) can be internally or externally located with respect to the reservoirs 404 and can rely on radiant, conductive, or convective heat to bring the ink in the reservoirs to at least the phase change melting temperature. The reservoirs and conduits that are a part of the phase change ink systems described herein can be selectively heated to maintain an appropriate ink temperature range and such heating control can include temperature monitoring and adjustment of heating power and/or timing.

Ink from the reservoirs 404 is directed to at least one printhead via an ink supply path 410. The ink supply path 410 can be any suitable device or apparatus capable of transmitting fluid, such as melted ink, from the ink reservoirs 404 to at least one printhead and, in one embodiment, to an on-board ink reservoir of the at least one printhead. The ink supply path 410 can be a conduit, trough, gutter, duct, tube or similar structure, or enclosed pathway that can be externally or internally heated in any suitable manner to maintain phase change ink in liquid form.

Referring now to FIGS. 1-4, electrical circuit diagrams illustrating alternative embodiments of a heater device configured to vary electrical current flow to a plurality of resistive heater elements are shown. In one embodiment, the heater device depicted in FIGS. 1-4 is operatively associated with the melter assembly 102 of the printer 10 to heat the melt plates 112, 114, 116, and 118 to melt solid phase change ink into liquid form. Each of the heater devices 201, 202, 203, and 204 include a first resistive heater element $\mathbf{206}_x$ that is configured for electrical connection to an electrical power source $\mathbf{210}_x$ and a second resistive heater element $\mathbf{208}_x$ that is configured for electrical connection to an electrical return for the electrical power source $\mathbf{210}_x$. The electrical return can be a terminal on the electrical power source or electrical ground.

The contact portion 130 and drip point portion 132 of each melt plate 112, 114, 116, and 118 generally define a melting surface 130, 132 to which the first and second resistive heater elements $\mathbf{206}_x$ and $\mathbf{208}_x$ are thermally connected. These thermal connections enable the first and second resistive heater elements $\mathbf{206}_x$ and $\mathbf{208}_x$ to heat the melting surfaces 130, 132 to a temperature within a predetermined temperature range. In one embodiment, the first and second resistive heater elements $\mathbf{206}_x$ and $\mathbf{208}_x$ are thermally connected to the melting surfaces 130, 132, which can be in the form of a planar member as shown in the figures, opposite the surface that the solid ink contacts for melting. In another embodiment, the first and second resistive heater elements $\mathbf{206}_x$ and $\mathbf{208}_x$ are thermally connected to the melting surfaces 130 and 132 that are adjacent to the surface that the solid ink contacts for melting. In yet another embodiment, the first and second resistive heater elements $\mathbf{206}_x$ and $\mathbf{208}_x$ are thermally connected to the melting surfaces 130 and 132 that are in direct contact with the solid ink. In one embodiment, the first resistive heater element $\mathbf{206}_x$ is configured to heat the contact portion 130 and the second resistive heater element $\mathbf{208}_x$ is configured to heat the drip point portion 132.

Each of the heater devices 201, 202, 203, and 204 further include a variable resistive heater element $\mathbf{212}_x$ electrically connected at a first end $\mathbf{214}_x$ to the first resistive heater element $\mathbf{206}_x$ and electrically connected at a second end $\mathbf{216}_x$ to the second resistive heater element $\mathbf{208}_x$. The variable resistive heater element $\mathbf{212}_x$ is configured to enable electrical current to flow through the first resistive heater element $\mathbf{206}_x$, and to restrict electrical current flow through the second resistive heater element $\mathbf{208}_x$, in response to the variable resistive heater element $\mathbf{212}_x$ being less than a predetermined temperature. Restriction of current flow refers to a flow of current that is appreciably less than the flow of current that occurs once a predetermined temperature threshold is reached. The variable resistive heater element $\mathbf{212}_x$ is further configured to enable electrical current to flow through the first and the second resistive heater elements $\mathbf{206}_x$ and $\mathbf{208}_x$ in response to the variable resistive heater element $\mathbf{212}_x$ being at or greater than a predetermined temperature.

In the embodiments of FIGS. 1-4, the heater device 201, 202, 203, and 204 includes an electrical power source $\mathbf{210}_x$ that is operatively connected to the first resistive heater $\mathbf{206}_x$ and configured to supply electrical power to the first resistive heater element $\mathbf{206}_x$. In one embodiment, the electrical power source $\mathbf{210}_x$ is configured to operate in a constant voltage mode and generate a constant voltage. In an alternative embodiment, the electrical power source $\mathbf{210}_x$ is configured to operate in a variable voltage mode and generate a variable voltage.

To operate the electrical power source $\mathbf{210}_x$ in the variable voltage mode, each of the heater devices 201, 202, 203, and 204 includes a controller, such as the controller 80, that is operatively connected to the electrical power source $\mathbf{210}_x$. In this embodiment, the controller 80 operates the electrical power source $\mathbf{210}_x$ at a first voltage ($V_1$) while the variable resistive heater element $\mathbf{212}_x$ is below the predetermined temperature. Once the variable resistive heater element $\mathbf{212}_x$ reaches or exceeds the predetermined temperature, the controller 80 operates the electrical power source $\mathbf{210}_x$ at a second voltage ($V_2$) that is less than the first voltage level $V_1$. To operate the electrical power source $\mathbf{210}_x$ in the constant voltage mode, each of the heater devices 201, 202, 203, and 204 includes a controller configured to use temperature feedback to operate the devices.

In different embodiments, the variable resistive heater element $\mathbf{212}_x$ is one or more of a positive temperature coefficient (PTC) heater element and a negative temperature coefficient (NTC) heater element. As used herein, the term "PTC heater element" or "PTC element" means an electrical component having a resistance that increases in a controlled fashion as the temperature of the PTC element increases above some threshold. A plotted graph of the resistance and the temperature of the PTC element is commonly referred to as an R/T curve. The threshold temperature above which the resistance of the PTC element increases rapidly is referred to as the Currie Temperature at which the R/T curve of the PTC element exhibits a distinctive transition. Before the Currie Temperature, the resistance can be unchanging or even decline slightly, but as the Curie temperature is exceeded, the slope of increasing resistance typically becomes very steep.

As used herein, the term "NTC heater element" or "NTC element" means an electrical component having a resistance that decreases in a controlled fashion as the temperature of the NTC element increases above some threshold. Similar to PTC elements, an NTC element has an R/T curve. However, after the Currie Temperature of the NTC element is exceeded, the R/T curve exhibits a distinct transition into a steep slope of decreasing resistance. As used herein, the term "transition temperature" means the Currie Temperature of a PTC element or an NTC element. In one embodiment, the predetermined temperature of the variable resistive heater element $\mathbf{212}_x$ is the transition temperature.

In one embodiment, the variable resistive heater element $\mathbf{212}_x$ is thermally isolated from the first and the second resistive heater elements $\mathbf{206}_x$ and $\mathbf{208}_x$. For example, the variable resistive heater element $\mathbf{212}_x$ can be configured as a free-standing component of each of the heater devices 201, 202, 203, and 204. In another example, the variable resistive heater element $\mathbf{212}_x$ can be configured to hang off of each of the heater devices 201, 202, 203, and 204 via solder pads or the like. In yet further examples, the variable resistive heater element $\mathbf{212}_x$ is thermally isolated from the first and the second resistive heater elements $\mathbf{206}_x$ and $\mathbf{208}_x$ by any method of attachment that enables the variable resistive heater element $212_x$ to be unaffected by the changing temperatures of the first and the second resistive heater elements $206_x$ and $208_x$.

Referring now to FIG. 1, the heater device 201 is shown in a first embodiment. The first and the second resistive heater elements $206_1$ and $208_1$ are connected to one another in a series electrical circuit. The variable resistive heater element $212_1$ is configured as a PTC heater element $218_1$ and is connected with the second resistive heater element $208_1$ in a parallel electrical circuit.

The heater device 201 is configured to operate at the first voltage $V_1$ to provide rapid, initial heating of the melt plates 112, 114, 116, and 118. Once the melt plates 112, 114, 116, and 118 have been heated to the predetermined temperature range, the heating device 201 is configured to operate at the second voltage $V_2$. The second voltage $V_2$ is typically a voltage supplied for steady state operation of the heater device 201. As used herein, the term "predetermined temperature range" means a temperature range at which the melt plates 112, 114, 116, and 118 cause solid phase change ink to reach the melting temperature or the drip temperature.

The PTC element $218_1$ of the heater device 201 has a time constant ($t_{ptc}$) that denotes the time required for the PTC element $218_1$ to reach its transition temperature when exposed to the first voltage $V_1$. The PTC element $218_1$ has a first resistance ($R_1$) that is less than a resistance ($R_2$) of the second resistive heater element $208_1$ when the melt plates 112, 114, 116, and 118 are at the non-melting temperature ($T_1$). In one embodiment, the first resistance $R_1$ of the PTC element $218_1$ is less than or equal to approximately twelve percent (12%) of the resistance $R_2$ of the second resistive heater element $208_1$ at the non-melting temperature $T_1$.

The PTC element $218_1$ also has a second resistance ($R_3$) that is greater than the resistance $R_2$ of the second resistive heater element $208_1$ when the melt plates 112, 114, 116, and 118 are at the melting temperature ($T_2$). In one embodiment, the second resistance $R_3$ of the PTC element $212_1$ is greater than or equal to approximately two-hundred percent (200%) the resistance $R_2$ of the second resistive heater element $2081_1$ at the melting temperature $T_2$.

During an initial stage of the melt cycle, the controller 80 is configured to operate the electrical power source $210_1$ to supply the heater device 201 with the first voltage $V_1$. In this embodiment, the first voltage $V_1$ is supplied for a first time period ($t_1$) that is less than or equal to the time constant $t_{ptc}$ of the PTC element $218_1$. During the first time period $t_1$, an elevated level of current flows through the first resistive heater element $206_1$ while the second resistive heater element $208_1$ is protected from this elevated current flow. The second resistive heater element $208_1$ is protected from the elevated current flow because the first resistance $R_1$ of the PTC element $218_1$ is far lower than the resistance $R_2$ of the second resistive heater element $208_1$. Although the first time period $t_1$ has been described in this embodiment as being less than or equal to the time constant $t_{ptc}$ of the PTC element $218_1$, the first time period $t_1$ can be equal to or greater than the time constant $t_{ptc}$ of the PTC element $218_1$ in other embodiments.

As the melt cycle continues, the PTC element $218_1$ self-heats and approaches its transition temperature, which occurs at the time constant $t_{ptc}$ of the PTC element $218_1$. As used herein, the term "self-heat" means that the PTC element $218_1$ increases in temperature as a result of internally generated heat as opposed to heat generated by direct contact with the first and the second resistive heating elements $206_1$ and $208_1$. Just before the time constant $t_{ptc}$ is reached, the controller 80 is configured to reduce the voltage supplied to the heater device 201 from the first voltage $V_1$ to the second voltage $V_2$. This reduction in voltage enables the first resistive heater element $206_1$ to be powered at levels designed to achieve target melt rates after the time constant $t_{ptc}$ is reached. The reduction in voltage from $V_1$ to $V_2$ also enables the second resistive heater element $208_1$ to be powered at levels required to achieve desired melt temperatures. In this embodiment, the current flow to the PTC element $218_1$ is minimized after the time constant $t_{ptc}$ of the PTC element $218_1$ is reached because the second resistance $R_3$ of the PTC element $218_1$ is greater than the resistance $R_2$ of the second resistive heater element $208_1$.

Figure 2:
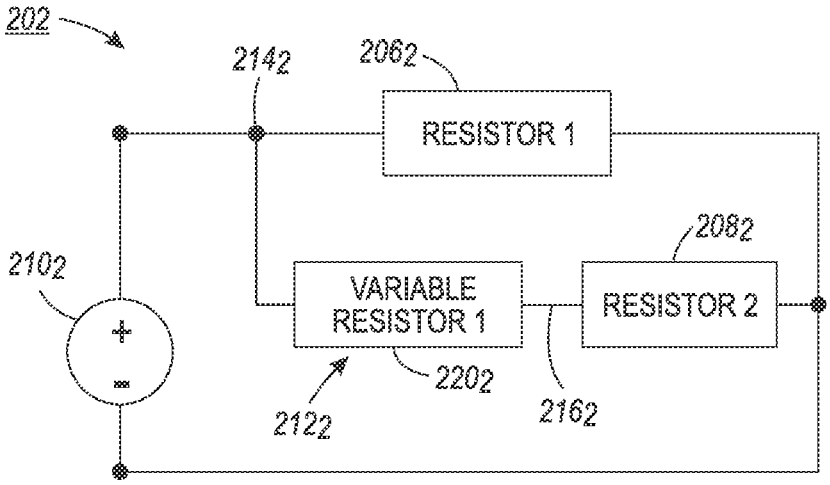
FIGS. 2-4 are electrical circuit diagrams illustrating alternative embodiments of the heater device of FIG. 1.

Referring now to FIG. 2, the heater device 202 is shown in a second embodiment. The first and the second resistive heater elements $206_2$ and $208_2$ are connected to one another in a parallel electrical circuit. The variable resistive heater element $212_2$ is configured as an NTC heater element $220_2$ and is connected to the second resistive heater element $208_2$ in a series electrical circuit.

Similar to the heater device 201, the heater device 202 is configured to operate at the first voltage $V_1$ to provide rapid, initial heating of the melt plates 112, 114, 116, and 118. Once the melt plates 112, 114, 116, and 118 have been heated to the predetermined temperature range, the heating device 202 is configured to operate at the second voltage $V_2$.

The NTC element $220_2$ of the heater device 201 has a time constant ($t_{ntc}$) that denotes the time required for the NTC element $220_2$ to reach its transition temperature when exposed to the first voltage $V_1$. At the non-melting temperature $T_1$ of the melt plates 112, 114, 116, and 118, a sum of a first resistance ($R_4$) of the NTC element $220_2$ and the resistance $R_2$ of the second resistive heater element $208_2$ is greater than a resistance ($R_5$) of the first resistive heater element $206_2$. In one embodiment, the sum of the first resistance $R_4$ of the NTC element $220_2$ and the resistance $R_2$ of the second resistive heater element $208_2$ is greater than or equal to three-hundred-fifty percent (350%) of the resistance $R_5$ of the first resistive heater element $206_2$.

Also at the non-melting temperature $T_1$ of the melt plates 112, 114, 116, and 118, the first resistance $R_4$ of the NTC element $220_2$ is greater than the resistance $R_2$ of the second resistive heater element $208_2$. In the embodiment noted in the previous paragraph, the first resistance $R_4$ of the NTC element $220_2$ is greater than or equal to two-hundred (200%) the resistance $R_2$ of the second resistive heater element $208_2$.

At the melting temperature $T_2$ of the melt plates 112, 114, 116, and 118, a sum of a second resistance ($R_6$) of the NTC element $220_2$ and the resistance $R_2$ of the second resistive heater element $208_2$ is approximately equal to the resistance $R_5$ of the first resistive heater element $206_2$. Also at the melting temperature $T_2$, the second resistance $R_6$ of the NTC element $220_2$ is less than the resistance $R_2$ of the second resistive heater element $208_2$. In one embodiment, the second resistance $R_6$ of the NTC element $220_2$ is less than or equal to ten percent (10%) of the resistance $R_2$ of the second resistive heater element $208_2$.

During an initial stage of the melt cycle, the controller 80 is configured to operate the electrical power source $210_2$ to supply the heater device 202 with the first voltage $V_1$. In this embodiment, the first voltage $V_1$ is supplied for a first time period ($t_1$) that is less than or equal to the time constant $t_{ntc}$ of the NTC element $220_2$. During the first time period $t_1$, an elevated level of current flows through the first resistive heater element $206_2$ while the second resistive heater element $208_2$ is protected from this elevated current flow. The second resistive heater element $208_2$ is protected from the elevated current flow because the sum of the first resistance $R_4$ of the NTC element $220_2$ and the resistance $R_2$ of the second resistive heater element $\mathbf{208}_2$ is far greater than the resistance $R_5$ of the first resistive heater element $\mathbf{206}_2$.

As the melt cycle continues, the NTC element $\mathbf{220}_2$ self-heats and approaches its transition temperature, which occurs at the time constant $L_{ntc}$ of the NTC element $\mathbf{220}_2$. As used herein, the term "self-heat" means that the NTC element $\mathbf{220}_2$ increases in temperature as a result of internally generated heat as opposed to heat generated by direct contact with the first and the second resistive heating elements $\mathbf{206}_2$ and $\mathbf{208}_2$. Just before the time constant $L_{ntc}$ is reached, the controller 80 is configured to reduce the voltage supplied to the heater device 202 from the first voltage $V_1$ to the second voltage $V_2$. This reduction in voltage enables the first resistive heater element $\mathbf{206}_2$ to be powered at levels designed to achieve target melt rates after the time constant $t_{ntc}$ is reached. The reduction in voltage from $V_1$ to $V_2$ also enables the second resistive heater element $\mathbf{208}_2$ to be powered at levels required to achieve desired melt temperatures.

Figure 3:
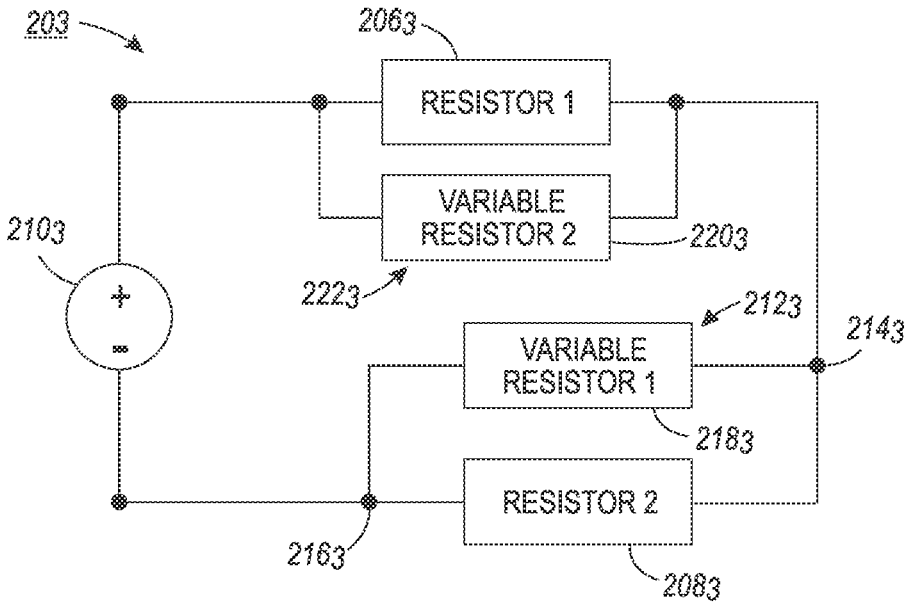
Figure 4:
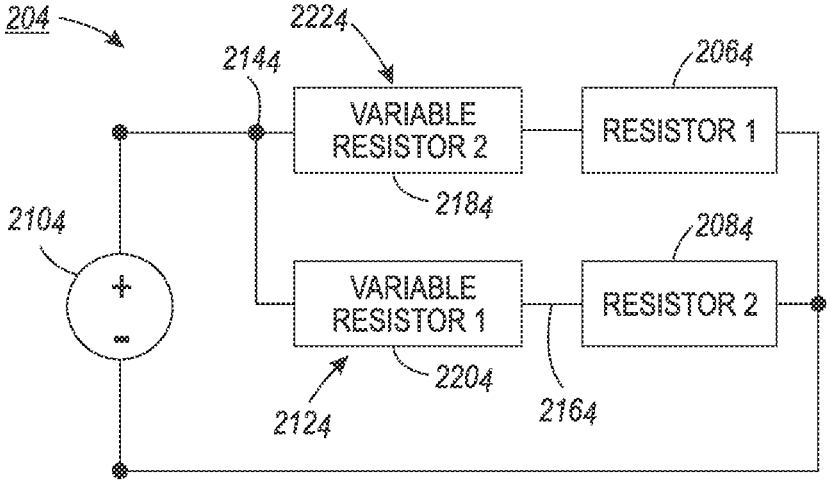

FIGS. 3 and 4 depict alternative embodiments of the heater device 203, 204 that further include a second variable resistive heater element $\mathbf{222}_x$. In these embodiments, the variable resistive heater element $\mathbf{212}_x$ and the second variable resistive heater element $\mathbf{222}_x$ are configured to vary electric current flow to the first and the second resistive heater elements $\mathbf{206}_x$ and $\mathbf{208}_x$.

Referring now to FIG. 3, the heater device 203 is shown in a third embodiment. The first and second resistive heater elements $\mathbf{206}_3$ and $\mathbf{208}_3$ are connected to one another in a series electrical circuit. The variable resistive heater element $\mathbf{212}_3$ is configured as a PTC heater element $\mathbf{218}_3$ and is connected to the second resistive heater element $\mathbf{208}_3$ in a parallel electrical circuit. The second variable resistive heater element $\mathbf{222}_3$ is configured as an NTC heater element $\mathbf{220}_3$ and is connected in a parallel electrical circuit with the first resistive heater element $\mathbf{206}_3$.

Referring now to FIG. 4, the heater device 204 is shown in a fourth embodiment. The variable resistive heater element $\mathbf{212}_4$ is configured as an NTC heater element $\mathbf{220}_4$ and is connected to the second resistive heater element $\mathbf{208}_4$ in a series electrical circuit. The second variable resistive heater element $\mathbf{222}_4$ is configured as a PTC heater element $\mathbf{218}_4$ and is connected to the first resistive heater element $\mathbf{206}_4$ in a series electrical circuit. The serially connected PTC heater element $\mathbf{220}_4$ and the first resistive heater element $\mathbf{206}_4$ are connected in a parallel electrical circuit with the serially connected NTC heater element $\mathbf{220}_4$ and the second resistive heater element $\mathbf{208}_4$.

Similar to the first and second embodiments of the heater device 201, 202 (FIGS. 1 and 2), the third and fourth embodiments of the heater device 203, 204 (FIGS. 3 and 4) are configured to operate at the first voltage $V_1$ to provide rapid, initial heating of the melt plates 112, 114, 116, 118. However, unlike the first and second embodiments, a reduction in the supplied voltage from $V_1$ to $V_2$ that is coincident with the respective time constants $t_{ptc}$, $t_{ntc}$ of the PTC element and the NTC element is not necessary in the third of and fourth embodiments. The configuration of the first and the second variable resistive heater elements $\mathbf{212}_x$ and $\mathbf{222}_x$ performs this function in these latter embodiments.

In the third and fourth embodiments of the heater device 203, 204, the respective time constants $t_{ptc}$, $t_{ntc}$ of the PTC element $\mathbf{218}_{3,4}$ and the NTC element $\mathbf{220}_{3,4}$ are configured to be approximately equal. The resistance ratios among the PTC element $\mathbf{218}_{3,4}$, the NTC element $\mathbf{220}_{3,4}$, and the first and the second resistive heater elements $\mathbf{206}_{3,4}$ and $\mathbf{208}_{3,4}$ below the transition temperature are configured to ensure the second resistive heater element $\mathbf{208}_{3,4}$ is protected from elevated current flow during the initial stage of the melt cycle. At or above the transition temperature, these resistance ratios are configured to reduce the current flow to the first resistive heater element $\mathbf{206}_{3,4}$ and enable non-elevated current to flow through the second resistive heater element $\mathbf{208}_{3,4}$.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A heater for use in melting solid ink comprising:

a first resistive heater element configured for electrical connection to an electrical power source;

a second resistive heater element configured for electrical connection to an electrical return for the electrical power source;

a variable resistive heater element electrically connected at a first end to the first resistive heater element and electrically connected at a second end to the second resistive heater element, the variable resistive heater element being configured to enable electrical current to flow through the first resistive heater element, and to restrict electrical current flow through the second resistive heater element in response to the variable resistive heater element being less than a predetermined temperature and to enable electrical current to flow through the first and the second resistive heater elements in response to the variable resistive heater element being at or greater than a predetermined temperature;

an electrical power source electrically connected to the first resistive heater element to supply electrical power to the first resistive heater element; and a controller operatively connected to the electrical power source, the controller being configured to operate the electrical power source at a first voltage level while the variable resistive heater element is below the predetermined temperature and to operate the electrical power at a second voltage level while the variable resistive heater element is at or above the predetermined temperature, the second voltage level being less than the first voltage level.

2. The heater of claim 1 further comprising:

a planar member thermally connected to the first resistive heater element and to the second resistive heater element to enable the first resistive heater element and the second resistive heater element to heat the planar member to a temperature within a predetermined temperature range.

3. The heater of claim 1 wherein the variable resistive heater element being one of a positive temperature coefficient (PTC) and a negative temperature coefficient (NTC) heater element.

4. The heater of claim 1 wherein the variable resistive heater element is a positive temperature coefficient (PTC) heater element connected in a parallel electrical circuit to the second resistive heater element.

5. The heater of claim 1 wherein the variable resistive heater element is a negative temperature coefficient (NTC) heater element electrically connected in series to the second resistive heater element, and the NTC heater element and the second resistive heater element being connected in a parallel electrical circuit to the first resistive heater element.

6. A heater for use in melting solid ink comprising:

a first resistive heater element configured for electrical connection to an electrical power source;

a second resistive heater element configured for electrical connection to an electrical return for the electrical power source; and a variable resistive heater element electrically connected at a first end to the first resistive heater element and electrically connected at a second end to the second resistive heater element and the variable resistive heater element is thermally insulated from the first resistive heater element and the second resistive heater element, the variable resistive heater element being configured to enable electrical current to flow through the first resistive heater element and to restrict electrical current flow through the second resistive heater element in response to the variable resistive heater element being less than a predetermined temperature, and to enable electrical current to flow through the first and the second resistive heater elements in response to the variable resistive heater element being at or greater than a predetermined temperature.

7. A heater for use in melting solid ink comprising:

a first resistive heater element configured for electrical connection to an electrical power source;

a second resistive heater element configured for electrical connection to an electrical return for the electrical power source;

a first variable resistive heater element electrically connected at a first end to the first resistive heater element and electrically connected at a second end to the second resistive heater element, the first variable resistive heater element being configured to enable electrical current to flow through the first resistive heater element and to restrict electrical current flow through the second resistive heater element in response to the first variable resistive heater element being less than a predetermined temperature, and to enable electrical current to flow through the first and the second resistive heater elements in response to the first variable resistive heater element being at or greater than a predetermined temperature; and a second variable resistive heater element, the second variable resistive heater element being a NTC heater element connected in a parallel electrical circuit with the first resistive heater element, and the first variable resistive heater element being a PTC heater element connected in a parallel electrical circuit to the second resistive heater element.

8. A heater for use in melting solid ink comprising:

a first resistive heater element configured for electrical connection to an electrical power source;

a second resistive heater element configured for electrical connection to an electrical return for the electrical power source;

a first variable resistive heater element electrically connected at a first end to the first resistive heater element and electrically connected at a second end to the second resistive heater element, the first variable resistive heater element being configured to enable electrical current to flow through the first resistive heater element and to restrict electrical current flow through the second resistive heater element in response to the first variable resistive heater element being less than a predetermined temperature and to enable electrical current to flow through the first and the second resistive heater elements in response to the first variable resistive heater element being at or greater than a predetermined temperature; and a second variable resistive heater element, the second variable resistive heater element being a PTC heater element connected in series with the first resistive heater element, and the first variable resistive heater element being a NTC heater element connected in series with the second resistive heater element, and the serially connected PTC heater element and the first resistive heater element being connected in a parallel electrical circuit with the NTC heater element and the second resistive heater element.

9. A melter device for melting solid ink comprising:

a first resistive heater element configured for electrical connection to an electrical power source;

a second resistive heater element configured for electrical connection to an electrical return for the electrical power source;

a variable resistive heater element electrically connected at a first end to the first resistive heater element and electrically connected at a second end to the second resistive heater element and the variable resistive heater element being thermally insulated from the first resistive heater element and the second resistive heater element, the variable resistive heater element being configured to enable electrical current to flow through the first resistive heater element and to restrict electrical current flow through the second resistive heater element in response to the variable resistive heater element being less than a predetermined temperature and to enable electrical current to flow through the first and the second resistive heater elements in response to the variable resistive heater element being at or greater than a predetermined temperature; and a melt plate configured to receive and melt the solid ink, the melt plate having at least one planar member thermally connected to the first resistive heater element and to the second resistive heater element to enable the first resistive heater element and the second resistive heater element to heat the planar member to a temperature within a predetermined temperature range.

10. The melter device of claim 9 wherein the variable resistive heater element being one of a positive temperature coefficient (PTC) and a negative temperature coefficient (NTC) heater element.

11. The melter device of claim 9 wherein the variable resistive heater element is a positive temperature coefficient (PTC) heater element connected in a parallel electrical circuit to the second resistive heater element.

12. The melter device of claim 9 wherein the variable resistive heater element is a negative temperature coefficient (NTC) heater element electrically connected in series to the second resistive heater element, and the NTC heater element and the second resistive heater element being connected in a parallel electrical circuit to the first resistive heater element.

13. The melter device of claim 9 wherein the at least one planar member has a contact region configured to melt the solid ink and a lower region configured to direct a flow of the melted ink, the first resistive heater element being configured to heat the contact region of the planar member and the second resistive heater element being configured to heat the lower region of the planar member.

14. A melter device for melting solid ink comprising:

a first resistive heater element configured for electrical connection to an electrical power source;

a second resistive heater element configured for electrical connection to an electrical return for the electrical power source;

a first variable resistive heater element electrically connected at a first end to the first resistive heater element and electrically connected at a second end to the second resistive heater element, the first variable resistive heater element being configured to enable electrical current to flow through the first resistive heater element and to restrict electrical current flow through the second resistive heater element in response to the variable resistive heater element being less than a predetermined temperature, and to enable electrical current to flow through the first and the second resistive heater elements in response to the first variable resistive heater element being at or greater than a predetermined temperature;

a melt plate configured to receive and melt the solid ink, the melt plate having at least one planar member thermally connected to the first resistive heater element and to the second resistive heater element to enable the first resistive heater element and the second resistive heater element to heat the planar member to a temperature within a predetermined temperature range; and a second variable resistive heater element, the second variable resistive heater element being a NTC heater element connected in a parallel electrical circuit with the first resistive heater element, and the first variable resistive heater element being a PTC heater element connected in a parallel electrical circuit to the second resistive heater element.

15. A melter device for melting solid ink comprising:

a first resistive heater element configured for electrical connection to an electrical power source;

a second resistive heater element configured for electrical connection to an electrical return for the electrical power source;

a first variable resistive heater element electrically connected at a first end to the first resistive heater element and electrically connected at a second end to the second resistive heater element, the first variable resistive heater element being configured to enable electrical current to flow through the first resistive heater element and to restrict electrical current flow through the second resistive heater element in response to the variable resistive heater element being less than a predetermined temperature, and to enable electrical current to flow through the first and the second resistive heater elements in response to the first variable resistive heater element being at or greater than a predetermined temperature;

a melt plate configured to receive and melt the solid ink, the melt plate having at least one planar member thermally connected to the first resistive heater element and to the second resistive heater element to enable the first resistive heater element and the second resistive heater element to heat the planar member to a temperature within a predetermined temperature range; and a second variable resistive heater element, the second variable resistive heater element being a PTC heater element connected in series with the first resistive heater element, and the first variable resistive heater element being a NTC heater element connected in series with the second resistive heater element, and the serially connected PTC heater element and the first resistive heater element being connected in a parallel electrical circuit with the NTC heater element and the second resistive heater element.

16. An inkjet printer comprising:

an inkjet printing apparatus having a plurality of inkjet ejectors, the inkjet printing apparatus being configured to eject ink from the inkjet ejectors onto a substrate;

a first resistive heater element configured for electrical connection to an electrical power source;

a second resistive heater element configured for electrical connection to an electrical return for the electrical power source;

a variable resistive heater element electrically connected at a first end to the first resistive heater element and electrically connected at a second end to the second resistive heater element, the variable resistive heater element being configured to enable electrical current to flow through the first resistive heater element, and to restrict electrical current flow through the second resistive heater element, in response to the variable resistive heater element being less than a predetermined temperature and to enable electrical current to flow through the first and the second resistive heater elements in response to the variable resistive heater element being at or greater than a predetermined temperature;

a melt plate configured to receive and melt solid ink for delivery of the melted ink to the inkjet printing apparatus, the melt plate having at least one planar member thermally connected to the first resistive heater element and to the second resistive heater element to enable the first resistive heater element and the second resistive heater element to heat the planar member to a temperature within a predetermined temperature range;

an electrical power source electrically connected to the first resistive heater element to supply electrical power to the first resistive heater element; and a controller operatively connected to the electrical power source, the controller being configured to operate the electrical power source at a first voltage level while the variable resistive heater element is below the predetermined temperature and to operate the electrical power at a second voltage level while the variable resistive heater element is at or above the predetermined temperature, the second voltage level being less than the first voltage level.

* * * * *